US008410386B2

(12) United States Patent
Bohländer

(10) Patent No.: US 8,410,386 B2
(45) Date of Patent: Apr. 2, 2013

(54) CAM DISK AND SPRING EXCURSION SWITCH FOR A STORED-ENERGY SPRING MECHANISM AND STORED-ENERGY SPRING MECHANISM

(75) Inventor: Joachim Bohländer, Grosskrotzenburg (DE)

(73) Assignee: ABB Technology AG, Zurich (CH)

( * ) Notice: Subject to any disclaimer, the term of this patent is extended or adjusted under 35 U.S.C. 154(b) by 151 days.

(21) Appl. No.: 13/018,803

(22) Filed: Feb. 1, 2011

(65) Prior Publication Data

US 2011/0168533 A1 Jul. 14, 2011

Related U.S. Application Data

(63) Continuation of application No. PCT/EP2009/004809, filed on Jul. 3, 2009.

(30) Foreign Application Priority Data

Aug. 1, 2008 (DE) ..... 10 2008 035 871

(51) Int. Cl.
*H01H 5/10* (2006.01)

(52) U.S. Cl. ..... 200/400; 200/424; 200/430; 200/431

(58) Field of Classification Search ..... 200/17 R, 200/19.13, 19.2, 19.21, 19.22, 19.25, 37 A, 200/38 R, 38 C, 33 B, 400, 401, 424, 430, 200/431, 500, 501, 520, 533, 542, 551, 558, 200/568, 573, 574, 323, 324; 218/7, 14, 218/153, 154; 74/10.6, 838, 53–55, 122–125, 74/497, 567, 568 R See application file for complete search history.

(56) References Cited

U.S. PATENT DOCUMENTS 3,135,843 A * 6/1964 Margerie ..... 200/81.8
3,178,539 A * 4/1965 Crawford et al. ..... 337/310

(Continued)

FOREIGN PATENT DOCUMENTS

DE 20 15 630 A1 10/1971
DE 33 07 467 A1 9/1984

(Continued)

OTHER PUBLICATIONS

International Search Report (PCT/ISA/210) for PCT/EP2009/004809 dated Sep. 16, 2009.

*Primary Examiner* — Michael Friedhofer
(74) *Attorney, Agent, or Firm* — Buchanan Ingersoll & Rooney PC

(57) ABSTRACT

The disclosure relates to a cam disc and to a spring deflection switch having a cam disc for a spring-loaded drive, wherein the cam disc includes a first, second and third circumferential region, each having at least one corresponding radial extension, for actuating a pushbutton including a switching hysteresis. The at least one second radial extension is larger than the at least one third radial extension, which in turn is larger than the at least one first radial extension. The pushbutton can interact with the cam disc in the spring deflection switch such that when the pushbutton is applied by the first circumferential region, the switching contact assumes a first switching position, and when the pushbutton is applied by the second circumferential region, the switching contact assumes a second switching position, and when the pushbutton is applied by the third circumferential region, the switching contact remains in the switching position assumed earlier.

10 Claims, 3 Drawing Sheets

U.S. PATENT DOCUMENTS

| | | | | | |
|---|---|---|---|---|---|
| 3,238,797 | A | * | 3/1966 | Coughren | 74/55 |
| 3,321,588 | A | * | 5/1967 | Hamilton | 200/38 R |
| 3,380,022 | A | * | 4/1968 | Raschke | 340/463 |
| 3,398,248 | A | * | 8/1968 | Klauss | 200/574 |
| 3,678,780 | A | * | 7/1972 | Ponting | 74/568 R |
| 4,490,768 | A | | 12/1984 | Mori et al. | |
| 4,716,812 | A | | 1/1988 | Koerner et al. | |
| 4,968,861 | A | * | 11/1990 | Kuhn | 200/400 |
| 5,113,056 | A | * | 5/1992 | Kuhn | 200/400 |
| 5,541,378 | A | * | 7/1996 | Niklaus | 200/400 |
| 6,649,853 | B2 | * | 11/2003 | Takagi et al. | 218/7 |
| 6,667,452 | B2 | * | 12/2003 | Spiegel | 200/501 |

FOREIGN PATENT DOCUMENTS

| | | | |
|---|---|---|---|
| DE | 91 11 861 | U1 | 11/1991 |
| DE | 195 05 737 | C1 | 5/1996 |
| EP | 0 451 724 | A | 10/1991 |
| EP | 0 829 891 | A1 | 3/1998 |
| GB | 1 350 153 | A | 4/1974 |
| GB | 0 158 054 | A | 10/1985 |

* cited by examiner

CAM DISK AND SPRING EXCURSION SWITCH FOR A STORED-ENERGY SPRING MECHANISM AND STORED-ENERGY SPRING MECHANISM

RELATED APPLICATIONS

This application claims priority as a continuation application under 35 U.S.C. §120 to PCT/EP2009/004809, which was filed as an International Application on Jul. 3, 2009 designating the U.S., and which claims priority to German Application 10 2008 035 871.1 filed in Germany on Aug. 1, 2008. The entire contents of these applications are hereby incorporated by reference in their entireties.

FIELD

The disclosure relates to a cam disk for actuating a pushbutton and to a spring excursion switch with a corresponding cam disk and to a hydraulic stored-energy spring mechanism for a high-voltage circuit breaker, which can include such a spring excursion switch with a cam disk.

BACKGROUND INFORMATION

A known stored-energy spring mechanism is disclosed in European patent application EP 0829892 A1. This application discloses a stored-energy spring which pressurizes a fluid located in a storage cylinder via a pressure body and a pressure piston, which is capable of moving in sliding fashion in the storage cylinder. This fluid causes a drive rod to move. The drive rod is fixed on a drive piston, which is capable of moving in sliding fashion in a working cylinder. If the working piston is moved with the working rod into a first end position, it can close the circuit breaker. If the working piston is moved with the working rod into a second end position, it can open the circuit breaker.

That region of the working cylinder in which the working rod is located can be hydraulically connected to the storage cylinder. There can be fluid there which is under a high pressure.

If that region of the working cylinder which is remote from the working rod is hydraulically connected to the storage cylinder, the fluid which is under a high pressure can be delivered to this region of the working cylinder and the working piston can be moved into the first end position.

If that region of the working cylinder which is remote from the working rod is hydraulically connected to a low pressure tank, the fluid can be delivered from this region of the working cylinder into the low-pressure tank and the working piston can be moved into the second end position.

With each switching cycle, for example, with a movement of the working piston into the first end position and back into the second end position, a certain amount of fluid therefore flows out of the storage cylinder into the low-pressure tank. This reduces the volume in the storage cylinder and the stored-energy spring pushes the pressure piston deeper into the storage cylinder. In the process, the stored-energy spring is extended further.

The stored-energy spring mechanism has a spring excursion switch, which identifies when the stored-energy spring has reached a maximum permissible extent. This is referred to below as the switch-on extent. The spring excursion switch then switches on a pump, which pumps fluid from the low-pressure tank into the storage cylinder, as a result of which the stored-energy spring is tensioned again and as a result of which its extent is reduced. The spring excursion switch identifies when the stored-energy spring has reached a predetermined extent. This is referred to below as the switch-off extent, and switches the pump off again.

The switch-off extent of the stored-energy spring is smaller than the switch-on extent. The extent of the stored-energy spring therefore follows a hysteresis. This is referred to below as recharging hysteresis.

The recharging hysteresis is controlled by the spring excursion switch. The spring excursion switch includes a linearly movable toothed rack, which is coupled to the stored-energy spring and drives a cam disk, via a gearwheel. The cam disk includes a first circumferential region with a comparatively small radius and a second circumferential region with a comparatively large radius. A flank region is located between the first circumferential region and the second circumferential region, with the extent of the cam disk in the radial direction increasing approximately linearly from the radius of the first circumferential region up to the radius of the second circumferential region within the flank region. The cam disk actuates a monostable pushbutton, which has switching hysteresis and has at least one switching contact.

When the stored-energy spring reaches the switch-on extent, the second circumferential region acts upon the pushbutton. The pushbutton is thus pushed until the switching contact closes, as a result of which the pump is switched on. While the stored-energy spring is now tensioned, the cam disk rotates and first the flank region and then the first circumferential region acts upon the pushbutton. Owing to the switching hysteresis of the pushbutton, the switching contact only opens when the first circumferential region acts upon the pushbutton and the pushbutton is almost completely relieved of load. As long as the flank region of the cam disk acts upon the pushbutton, the switching contact remains closed. If the first circumferential region of the cam shaft acts upon the pushbutton, the stored-energy spring has reached the switch-off extent and the switching contact opens, as a result of which the pump is switched off.

If the stored-energy spring extends during operation of the stored-energy spring mechanism, the cam disk rotates in the opposite direction and the pushbutton is acted upon first by the flank region and then by the second circumferential region. Owing to the switching hysteresis of the pushbutton, the switching contact only closes when the second circumferential region acts upon the pushbutton and the switch-on extent of the stored-energy spring has been reached. As long as the flank region of the cam disk is acting upon the pushbutton, the switching contact remains open.

The greater the recharging hysteresis, the more fluid can flow out of the storage cylinder into the low-pressure tank before the pump is switched on.

SUMMARY

A cam disk is disclosed for actuating a pushbutton having switching hysteresis, including a first circumferential region with at least one first radial extent, a second circumferential region with at least one second radial extent, the at least one second radial extent being greater than the at least one first radial extent, and a third circumferential region with at least one third radial extent and arranged in a circumferential direction between the first circumferential region and the second circumferential region. The at least one third radial extent is greater than the at least one first radial extent and less than the at least one second radial extent.

BRIEF DESCRIPTION OF THE DRAWINGS

The disclosure, and exemplary embodiments will be explained and described in more detail with reference to the drawings, which illustrate an exemplary embodiment of the disclosure and in which.

DETAILED DESCRIPTION

Figure 1:
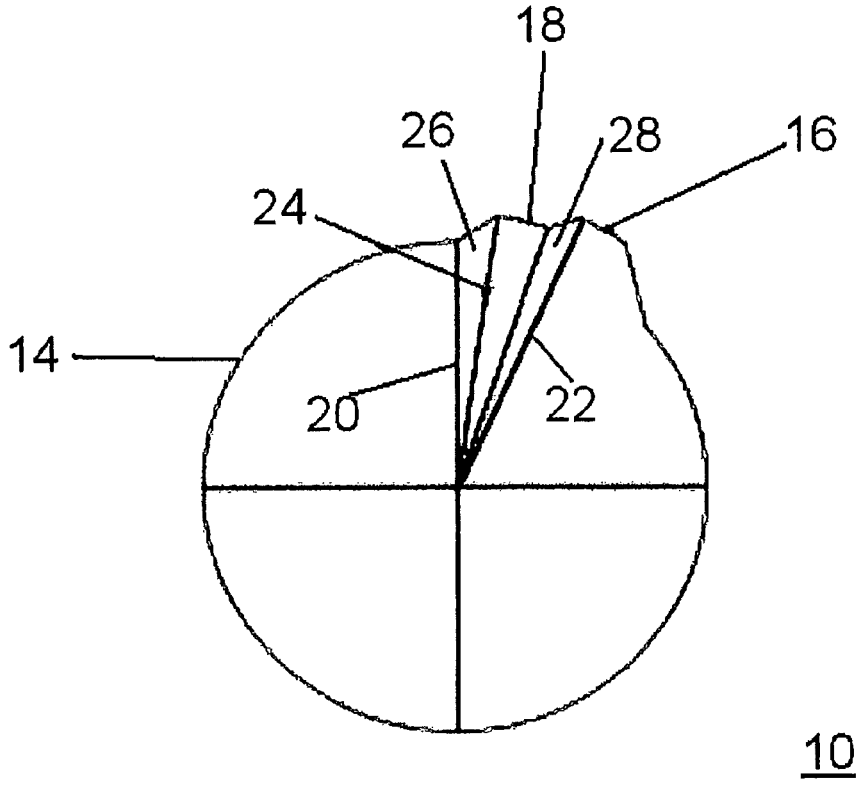
FIG. 1 shows an exemplary embodiment of a cam disk according to the disclosure.

The disclosure relates to a switching response of a hydraulic stored-energy spring mechanism of the generic type and to, for example, increasing recharging hysteresis and reducing the number of pump cycles involved in the use of a cam disk.

The cam disk according to an exemplary embodiment of the disclosure can actuate a pushbutton having switching hysteresis and includes a first circumferential region with at least one first radial extent and a second circumferential region with at least one second radial extent. The at least one second radial extent is greater than the at least one first radial extent. A third circumferential region with at least one third radial extent can be arranged in the circumferential direction between the first circumferential region and the second circumferential region. The at least one third radial extent is greater than the at least one first radial extent and less than the at least one second radial extent.

As long as a pushbutton is acted upon by the third circumferential region of the cam disk, the switching contact of the pushbutton, owing to the switching hysteresis, can remain in its previously assumed switching position. For example, only in the transition to the second circumferential region or to the first circumferential region does the switching contact switch on or off.

The recharging hysteresis of a hydraulic stored-energy spring mechanism with a spring excursion switch with such a cam disk can be adjusted by the size of the third circumferential region. For example, the recharging hysteresis can be increased by selecting a comparatively large third circumferential region in comparison with a known cam disk.

In an exemplary embodiment of the cam disk according to the disclosure, the third circumferential region has a third radial extent, which is approximately constant (e.g., ±10%) over the third circumferential region, for example, the third circumferential region can be approximately in the form of a segment of a circle with a third radius. As a result, can be possible to simplify the production of the cam disk.

Alternatively, provision can also be made for a circumferential region, such as the third circumferential region, to have a plurality of different radial extents, it being possible, for example, for the respective radial extent to increase in the circumferential direction from an initial value to an end value (for example, to increase continuously and/or for the third circumferential region to have a plurality of steps, also with different step heights and/or with different radial extents). In this case, provision can also be made for the respective circumferential region to be curved, such as with a circular, parabolic or elliptical curvature.

In accordance with an exemplary embodiment of the disclosure, a first flank region of the cam disk which can be arranged in the circumferential direction between the first circumferential region and the third circumferential region, can be designed to be comparatively small and can extend in the circumferential direction over an angle of at most 10°, preferably 8°.

In accordance with an exemplary embodiment of the disclosure, a second flank region of the cam disk can be arranged in the circumferential direction between the second circumferential region and the third circumferential region, and can be designed to be comparatively small and can extend in the circumferential direction over an angle of, for example, at most 10°, preferably 8°.

An exemplary advantage of a cam disk configured in this way is that the recharging hysteresis can be adjusted relatively accurately by selecting the size of the angle of the third circumferential region. The switching hysteresis of the pushbutton can be subject to tolerances. The switching contact of the pushbutton switches under real conditions as early as shortly before the transition from the third circumferential region to the first circumferential region and from the third circumferential region to the second circumferential region. The exact switching points of the pushbutton are within the first flank region and within the second flank region. Owing to the tolerance of the pushbutton, however, the switching points cannot be determined as precisely as desired.

The recharging hysteresis is therefore also subject to tolerances. By reducing the extents of the first flank region and the second flank region in the circumferential direction, the tolerance of the recharging hysteresis can therefore also be reduced.

Accordingly, a spring excursion switch according to an exemplary embodiment of the disclosure includes a cam disk according to an exemplary embodiment of the disclosure and a pushbutton having switching hysteresis and with at least one switching contact. In this case, the pushbutton interacts with the cam disk in such a way that, when the pushbutton is acted upon by the first circumferential region of the cam disk, the switching contact assumes a first switching position. When the pushbutton is acted upon by the second circumferential region of the cam disk, the switching contact assumes a second switching position. When the pushbutton is acted upon by the third circumferential region of the cam disk, the switching contact maintains the previously assumed switching position. For example, the switching contact can be closed in the second switching position and can be open in the first switching position.

The recharging hysteresis of a hydraulic stored-energy spring mechanism with such a spring excursion switch can be increased by using a cam disk according to an exemplary embodiment of the disclosure with a comparatively large third circumferential region.

A hydraulic stored-energy spring mechanism according to an exemplary embodiment of the disclosure for a high-voltage circuit breaker therefore can include a pump for conveying fluid from a low-pressure tank into a high-pressure store and a stored-energy spring for generating pressure in the high-pressure store and a spring excursion switch according to the disclosure. The spring excursion switch interacts with the stored-energy spring in such a way that the pushbutton of the spring excursion switch can be acted upon by the first circumferential region of the cam disk when the stored-energy spring has reached a predetermined switch-off extent. The pushbutton of the spring excursion switch can be acted upon by the second circumferential region of the cam disk when the stored-energy spring has reached a predetermined switch-on extent.

FIG. 1 illustrates an exemplary embodiment of a cam disk 10 according to the disclosure for use in a spring excursion switch. The cam disk 10 in this illustration has approximately the shape of a full circle. Other configurations, for example in the form of a semicircle or a quarter circle, are also conceivable. This can result in a reduction in the amount of space required in a spring excursion switch in which the cam disk is used.

The cam disk 10 has, inter alia, a first circumferential region 14 with a first radial extent (first radius) 20, a second circumferential region 16 with a second radial extent (second radius) 22 and a third circumferential region 18 with a third radial extent (third radius) 24. The second radial extent 22 can be, in an exemplary embodiment, greater than the third radial extent 24, which can be greater than the first radial extent 20. For example, the second circumferential region 16 can extend further in the radial direction than the third circumferential region 18, and the third circumferential region 18 can extend further in the radial direction than the first circumferential region 14.

The third circumferential region 18 can be located in the circumferential direction between the first circumferential region 14 and the second circumferential region 16 and, in an exemplary embodiment, can extend in the circumferential direction over an angle of approximately 10°. Other extents/extensions of the third circumferential region 18 in the circumferential direction are of course also possible. For example, extents/extensions of the third circumferential region 18 over angles of approximately 5° to approximately 20° (or lesser or greater) can be useful for use in a spring excursion switch for a hydraulic stored-energy spring mechanism 50.

The third radial extent (third radius) 24 of the third circumferential region 18 can be approximately constant and in this example can be approximately 22 mm. The first radial extent (first radius) 20 can likewise be constant and in this case can be approximately 20 mm. The second radial extent (second radius) 22 can also be constant and in this case can be approximately 24 mm. Other numerical values for the mentioned radial extents are also conceivable.

A first flank region 26 is located in the circumferential direction between the first circumferential region 14 and the third circumferential region 18. The extent of the first flank region 26 in an exemplary embodiment can increase in the radial direction from the size of the first radial extent 20 to the size of the third radial extent 24. In an exemplary embodiment, the extent of the first flank region 26 in the circumferential direction can be selected to be as small as possible and can extend over an angle of approximately 8°. If the extent of the first flank region 26 in the circumferential direction is selected to be too small, however, the first flank region 26 carries along a pushbutton, which interacts with the cam disk 10, in the transition from the first circumferential region 14 to the third circumferential region 18 in the circumferential direction instead of pushing the pushbutton in the radial direction. An extent of the first flank region 26 in the circumferential direction over an angle of approximately 8° can be useful in a spring excursion switch for a hydraulic stored-energy spring mechanism 50.

Correspondingly, there is a second flank region 28 in the circumferential direction between the second circumferential region 16 and the third circumferential region 18. The extent of the second flank region 28 in an exemplary embodiment can decrease in the radial direction from the size of the second radial extent 22 to the size of the third radial extent 24. In this case, the extent of the second flank region 28 in the circumferential direction can likewise be selected to be as small as possible and in this example extends over an angle of approximately 8°. If the extent of the second flank region 28 in the circumferential direction is selected to be too small, however, the second flank region 28 carries along a pushbutton, which interacts with the cam disk 10, in the transition from the third circumferential region 18 to the second circumferential region 16 in the circumferential direction instead of pushing the pushbutton in the radial direction. An extent of the second flank region 28 in the circumferential direction over an angle of approximately 8° can be useful in a spring excursion switch for a hydraulic stored-energy spring mechanism 50.

Figure 2:
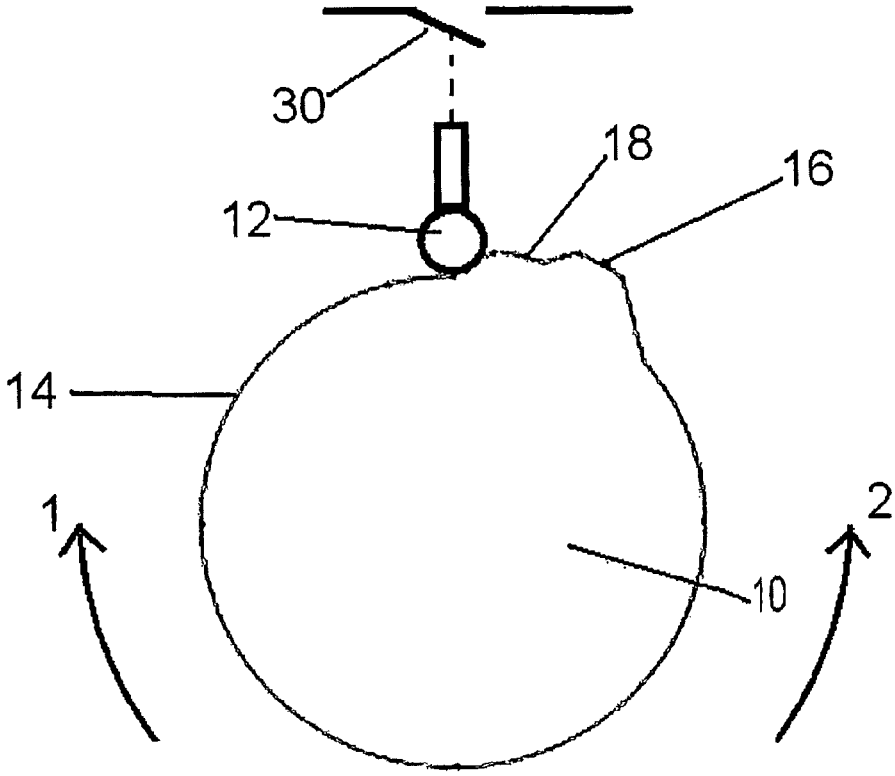
FIG. 2 shows an exemplary embodiment of a cam disk according to the disclosure in interaction with a pushbutton.
Figure 3:
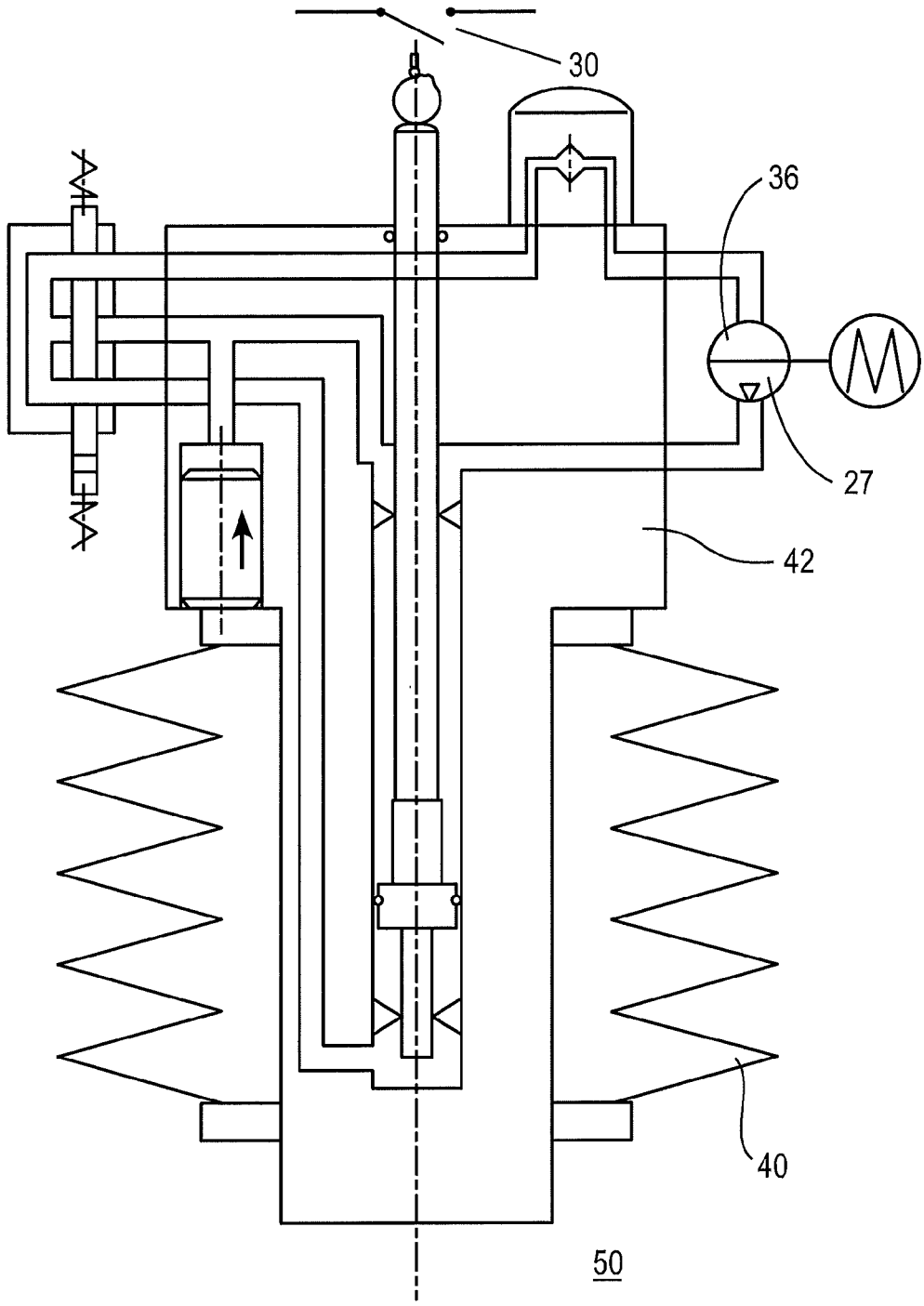
FIG. 3 shows an exemplary embodiment of a stored-energy spring mechanism according to the disclosure.

FIG. 2 illustrates a cam disk 10 according to an exemplary embodiment of the disclosure the disclosure in interaction with a pushbutton 12 for use in a spring excursion switch. The pushbutton 12 includes a schematically illustrated switching contact 30, which can assume two switching positions. In a first switching position, the switching contact 30 is open, and in a second switching position the switching contact 30 is closed.

In the illustration shown, the first circumferential region 14 of the cam disk 10 acts upon the pushbutton 12. The switching contact 30 assumes the first switching position and is open. A stored-energy spring 40 of a hydraulic stored-energy spring mechanism 50 has reached a predetermined switch-off extent and a pump 27 is switched off.

During operation of the stored-energy spring mechanism, the stored-energy spring 40 is extended and drives the cam disk 10 via a toothed rack and a gearwheel, as a result of which the cam disk can rotate in a second direction of rotation 2.

After a rotation of the cam disk through an exemplary angle of approximately 8°, which corresponds to the extent of the first flank region 26 in the circumferential direction, the third circumferential region 18 acts upon the pushbutton 12. The pushbutton 12 is pressed through approximately 2 mm, which corresponds to the difference between the third radial extent 24 and the first radial extent 20. Owing to the switching hysteresis of the pushbutton 12, the switching contact 30 remains open.

After a rotation of the cam disk through an angle of approximately 26°, which corresponds to the total extent of the first flank region 26 and the third circumferential region 18 and the second flank region 28 in the circumferential direction, the second circumferential region 16 acts upon the pushbutton 12. The pushbutton 12 is pressed through approximately 4 mm, which corresponds to the difference between the second radial extent 22 and the first radial extent 20. In this position, the stored-energy spring 40 has reached a predetermined switch-on extent, and the switching contact 30 of the pushbutton 12 closes and therefore switches the pump 27 on.

The stored-energy spring 40 is now tensioned and drives the cam disk 10 via the toothed rack and the gearwheel, as a result of which the cam disk rotates in a first direction of rotation 1. The pushbutton 12 is now acted upon successively by the second flank region 28, the third circumferential region 18 and the first flank region 26. Owing to the switching hysteresis of the pushbutton 12, the switching contact 30 remains closed during this time.

If the pushbutton 12 is acted upon by the first circumferential region 14, the stored-energy spring has reached a predetermined switch-off extent, and the switching contact 30 of the pushbutton 12 opens and therefore switches off the pump.

Part of the cam disk acting upon the pushbutton constitutes, for example, direct contact between the pushbutton and this part of the cam disk. However, it is also possible for a protective shroud, an additional probe or the like to be arranged between the pushbutton and the cam disk, with the result that the cam disk does not come into direct contact with the pushbutton. In these cases too, the pushbutton is acted upon by the cam disk.

It will be appreciated by those having ordinary skill in the art that the present invention can be embodied in other specific forms without departing from the spirit or essential characteristics thereof. The presently disclosed embodiments are therefore considered in all respects to be illustrative and not restricted. The scope of the invention is indicated by the appended claims rather than the foregoing description and all changes that come within the meaning and range and equivalence thereof are intended to be embraced therein.

LIST OF REFERENCE SYMBOLS

1 First direction of rotation
2 Second direction of rotation
10 Cam disk
12 Pushbutton
14 First circumferential region
16 Second circumferential region
18 Third circumferential region
20 First radial extent
22 Second radial extent
24 Third radial extent
26 First flank region
27 Pump
28 Second flank region
30 Switching contact
36 Lower-pressure tank
40 Stored energy spring
42 High-pressure store
50 Stored energy spring mechanism

What is claimed is:

1. A hydraulic stored-energy spring mechanism for a high-voltage circuit breaker, comprising:

a stored-energy spring for generating pressure in a high-pressure store;

a spring excursion switching including, a cam disk having a first circumferential region with at least one first radial extent, a second circumferential region with at least one second radial extent, the at least one second radial extent being greater than the at least one first radial extent, and a third circumferential region with at least one third radial extent and arranged in a circumferential direction between the first circumferential region and the second circumferential region, wherein the at least one third radial extent is greater than the at least one first radial extent and less than the at least one second radial extent, and a pushbutton having switching hysteresis and having at least one switching contact, for interacting with the cam disk such that when the pushbutton is acted upon through the first circumferential region, the switching contact assumes a first switching position, and when the pushbutton is acted upon through the second circumferential region, the switching contact assumes a second switching position, and when the pushbutton is acted upon through the third circumferential region, the switching contact maintains a previously assumed switching position;

the spring excursion switch for interacting with the stored-energy spring such that the first circumferential region of the cam disk acts upon the pushbutton of the spring excursion switch when the stored-energy spring has reached a predetermined switch-off extent, and the second circumferential region of the cam disk acts upon the pushbutton of the spring excursion switch when the stored-energy spring has reached a predetermined switch-on extent.

2. The hydraulic stored-energy spring mechanism as claimed in claim 1, wherein the third radial extent is substantially constant over the third circumferential region.

3. The hydraulic stored-energy spring mechanism as claimed in claim 1, wherein the third circumferential region extends in the circumferential direction over an angle of at least 5°.

4. The hydraulic stored-energy spring mechanism as claimed in claim 1, wherein the third circumferential region extends in the circumferential direction over an angle of from 5° to 20°.

5. The hydraulic stored-energy spring mechanism as claimed in claim 1, wherein a first flank region, which is arranged in the circumferential direction between the first circumferential region and the third circumferential region, extends in the circumferential direction over an angle of at most 10°.

6. The hydraulic stored-energy spring mechanism as claimed in claim 1, wherein a second flank region, which is arranged in the circumferential direction between the second circumferential region and the third circumferential region, extends in the circumferential direction over an angle of at most 10°.

7. The hydraulic stored-energy spring mechanism as claimed in claim 1, comprising:

a pump for delivering fluid from a low-pressure tank to the high-pressure store, wherein the switching contact of the pushbutton is operable in the second switching position for switching on the pump, and wherein the switching contact of the pushbutton is operable to switch off the pump in the first switching position.

8. The hydraulic stored-energy spring mechanism as claimed in claim 1, wherein the third circumferential region extends in the circumferential direction over an angle of from 10°.

9. The hydraulic stored-energy spring mechanism as claimed in claim 1, wherein a first flank region, which is arranged in the circumferential direction between the first circumferential region and the third circumferential region, extends in the circumferential direction over an angle of at most 8°.

10. The hydraulic stored-energy spring mechanism as claimed in claim 1, wherein a second flank region, which is arranged in the circumferential direction between the second circumferential region and the third circumferential region, extends in the circumferential direction over an angle of at most 8°.

* * * * *